US005860205A

United States Patent [19]

Davis

[11] Patent Number: 5,860,205

[45] Date of Patent: Jan. 19, 1999

[54] TOOL FOR INSTALLING AND REMOVING COMPUTER CONNECTORS

[75] Inventor: David R. Davis, Sioux City, Iowa

[73] Assignee: Gateway 2000, Inc., North Sioux City, S. Dak.

[21] Appl. No.: 751,841

[22] Filed: Nov. 18, 1996

[51] Int. Cl.[6] ..... H01R 43/22

[52] U.S. Cl. ..... 29/750; 29/758; 29/764; 7/138

[58] Field of Search ..... 29/758, 764, 750, 29/752, 762; 7/107, 138

[56] References Cited

U.S. PATENT DOCUMENTS

| | | | |
|---|---|---|---|
| 1,660,836 | 2/1928 | Gilks | 7/138 |
| 3,797,092 | 3/1974 | Einarson | 29/758 X |
| 3,896,533 | 7/1975 | Ullman et al. | 29/758 X |
| 4,141,138 | 2/1979 | Quick | 29/764 X |
| 4,723,361 | 2/1988 | Carlson et al. | 29/764 |
| 4,817,274 | 4/1989 | Higgins | 29/764 |
| 4,858,309 | 8/1989 | Korsunsky et al. | 29/764 |
| 5,280,659 | 1/1994 | Park | 7/107 X |

*Primary Examiner*—S. Thomas Hughes
*Assistant Examiner*—Rick Kiltae Chang
*Attorney, Agent, or Firm*—Schwegman, Lundberg, Woessner & Kluth, P.A.; Anthony Claiborne

[57] ABSTRACT

A tool is provided for removal and installation of computer disk drive connectors of various sizes. The tool is a useful, easy to use, inexpensive device. The same device is a useful tool for removing hex head screws commonly used in computers. The apparatus is also lightweight and compact thereby making it easy to transport and store within the computer, and to use with one hand.

9 Claims, 2 Drawing Sheets

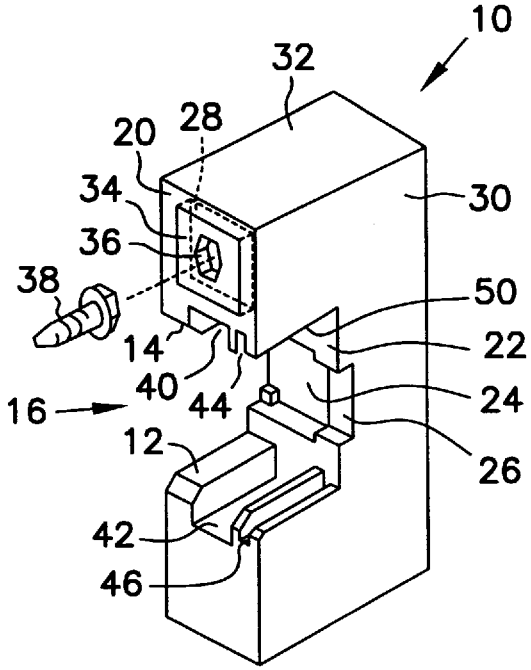
FIG. 1
FIG. 2
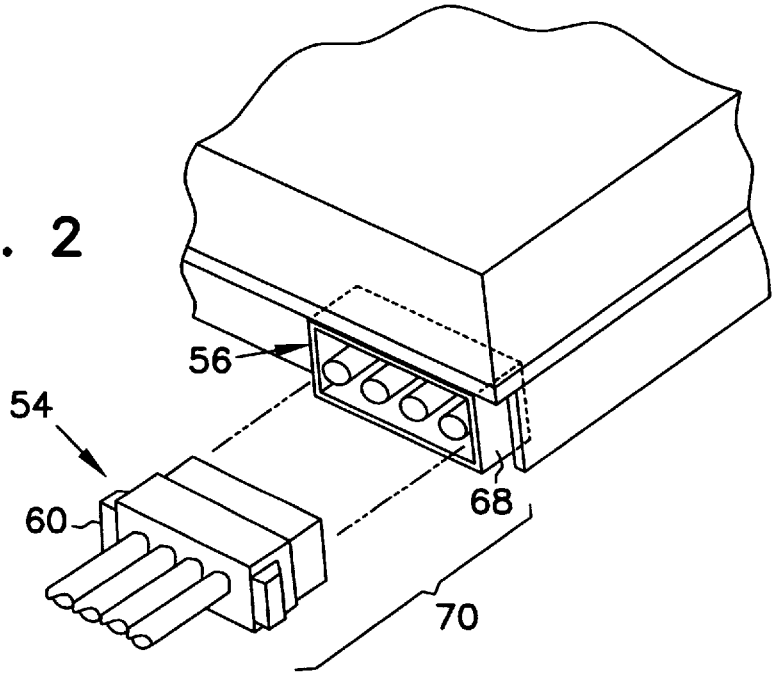

TOOL FOR INSTALLING AND REMOVING COMPUTER CONNECTORS

FIELD OF THE INVENTION

The present invention relates generally to apparatus for removing and installing computer connectors, and also for removing and installing hex head screws within a computer.

BACKGROUND OF THE INVENTION

Computers are widely used in almost every industry, and also widely used by consumers. Technology for computer systems is rapidly changing as new products emerge on a daily basis. The new products are becoming easy to install. As a result, many computer users are installing the new products themselves.

Additionally, the new computer products typically require large amounts of storage, or even new types of disk drives. Consequently, a computer user or service person is required to remove and install disk drive equipment and other equipment to and from the computer. Computers sometimes become damaged or in need of repair. A technician must disassemble and reassemble the computer to fix it. Lastly, during the manufacturing process of computers, various components of the computer must be assembled repeatedly. During the installation, modification, manufacture, and repair of computers, computer users and service persons often must remove various parts of the computer, including disk drive power connectors and hex head screws.

Disk drive connectors are comprised of two parts, male and female, which when engaged, provide an electrical connection from the computer system to individual disk drives. The connectors have several internal components which frictionally engage to provide the electrical and structural connection. The outcome is a large surface area which is frictionally engaged when the connectors are joined. As a result, a relatively large force is required to connect and disconnect the connectors, which is often done by humans. The connectors are compact, as space in a computer is at a premium. The connectors have a small rib which is used to apply force when removing or installing the connector. The considerable amount of force required, in combination with the small surface area of the rib to which the force is applied, results in substantial difficulty and inefficiency for the removal and installation of the connectors.

Frustrated with the magnitude of force required to remove the connectors by hand, individuals may resort to using sharp instruments or other potentially damaging devices to install or remove computer connectors, thereby increasing the risk of damage to equipment and electrical connections within the computer. Furthermore, individuals may also use excessive force when removing the connectors, or place excessive force in a localized area of the connector, which results in severed electrical connections.

Accordingly, there is a need for a better way to provide enough force to effectively handle computer connectors. What is also needed is a way to deal with a variety of connectors and screws within the computer.

SUMMARY OF THE INVENTION

A tool is provided to reduce the amount of manual labor required to remove and install connectors in computers, and to conveniently remove hex head screws commonly used in computers.

The tool is a useful, easy to use, inexpensive device for removal and installation of computer disk drive power connectors of various sizes. The same device is a useful tool for removing hex head screws commonly used in computers. The apparatus is also lightweight and compact thereby making it easy to transport and store within the computer, and to use with one hand.

The tool is for removing and installing computer connectors from mating connectors. The tool has a tool body with a cut-out, where the cut-out defines an engagement surface. The engagement surface has at least one channel adapted for engaging computer connector ribs such that force is applied to the tool body to remove or install a connector. The tool provides more surface area for the force to be distributed, and a user can apply a more uniform force to the connector without damaging the cables or surrounding equipment.

BRIEF DESCRIPTION OF THE DRAWINGS

FIG. 1 is a perspective view illustrating an apparatus constructed in accordance with the present invention.

FIG. 2 is a perspective view illustrating mating connectors.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the spirit and scope of the present invention. Therefore, the following detailed description is not to be taken in a limiting sense, and the scope of the present invention is defined by the appended claims.

Figure 3:
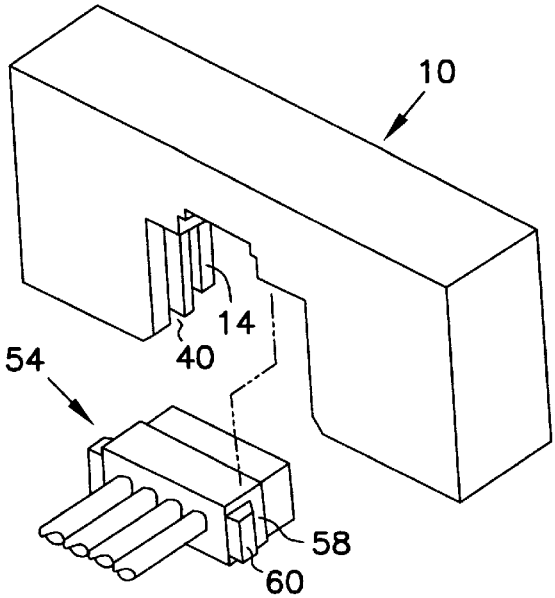
FIG. 3 is a perspective view illustrating an apparatus utilized in the manner prescribed by the present invention.
Figure 4:
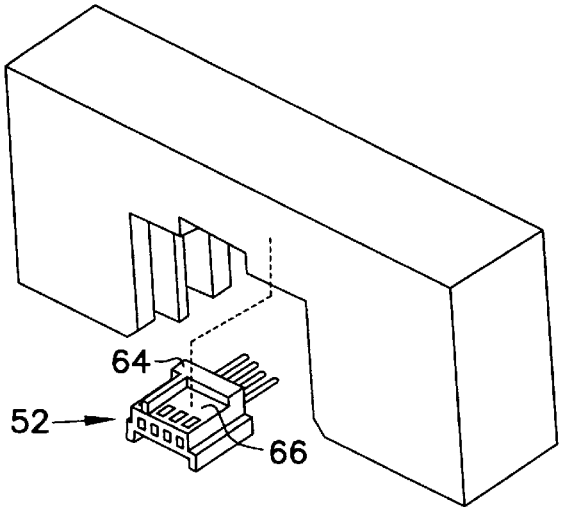
FIG. 4 is a perspective view illustrating an apparatus utilized in the manner prescribed by the present invention.

The present invention may be utilized with a standard type connector set 70 shown in FIG. 2. The connector set 70 is typically used on CD-ROMS, hard drives, tape back-ups, and 5¼" floppy disk drives for providing power to these units. The connector set 70 comprises female and male connectors, 54, 56, respectively, which have mating surfaces. An example of female connector 54 is Molex connector no. 8981-4P, and male connector 56 is Molex connector no. 8981-4R-1. The connectors 54, 56, also shown individually in FIG. 3, each comprise a plastic housing providing mating surfaces which provide retentive force. Within the plastic housings are pins which provide an electrical connection from one connector to another.

The female connector 54 has a pair of ribs 60 which extend outward from a side surface 58 of the female connector 54. For the female connector, the rib supplies a small surface to which force can be applied to engage or disengage a connector.

In FIG. 1, a computer connector removing and installing tool is indicated generally at 10. Tool 10 is generally U-shaped with a first surface 20 and tool body surfaces 30, 32. The tool 10 is lightweight, small sized and easily manipulated by one hand. In an alternative embodiment, the tool body surfaces 30, 32 may also be provided with a slip-resistant texture shown in FIG. 5 at 72.

Tool 10 includes a cut-out 16 which defines an engagement surface. Cut-out 16 has a bottom surface 22, and side surfaces 12, 14. The side surfaces 12, 14 have a pair of opposing channels 40 and 42 therein which are sized to slidably engage the connector rib 60 for a standard female connector. The side surfaces 12, 14 have another pair of opposing channels 44, 46, which are sized to slidably engage the connector rib 62 for a standard male connector.

Figure 5:
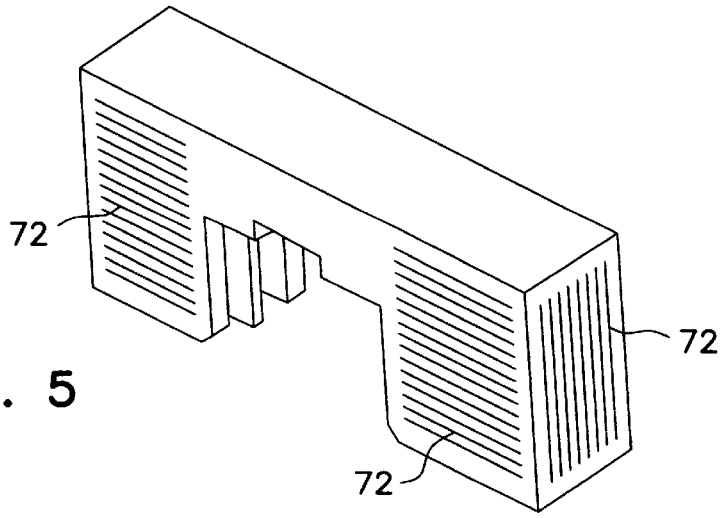
FIG. 5 is a perspective view illustrating an alternative embodiment of an apparatus prescribed by the present invention.

Tool 10 is preferably molded or machined from a lightweight, rigid material such as thermoplastic, although other materials may be used. Tool 10 also preferably provides a non-slip surface on tool body surfaces 30, 32 as shown in FIG. 5. The non-slip surface may be integrally molded on the tool body surfaces 30, 32. Alternatively, a non-slip surface having adhesive backing may be adhered to the tool body surfaces 30, 32, although other types of non-slip surfaces may be provided without departing from the scope of the invention.

The tool 10 is operated by sliding the channels 40, 42 over the connector rib 60 of the standard female connector 54. The female connector 54 is connected and disconnected from a male connector 56 by applying force to the tool body surfaces 30, 32 while the connector rib 60 is engaged by the opposing channels 40, 42. When sufficient force is applied to the tool body surfaces 30, 32, the force is transmitted to the connector rib 60 to overcome the frictional engagement of the internal components within the standard connector.

Tool 10 may also be utilized in conjunction with a smaller power connector 52, which is typically used for providing power to 3½" floppy disk drives. An example of connector 52 is Alex connector no. 1822-04. The connector 52 is smaller than the universal type female connector. The female power connector 52 has a top surface 66. A shoulder 64 extends upward from the top surface 66, which may be used to remove power connector 52 from a mating power connector.

The bottom surface 22 of tool 10 has a cavity 24 therein. The cavity 24 is configured with a stepped surface 26 to engage the shoulder 64 of a female connector. As illustrated in FIG. 5, the female connector 52 is removed and installed from a mating connector by sliding the tool 10 over connector 52. The stepped surface 26 of the cavity 24 is then engaged with the shoulder 64 of the connector 52. While so engaged, force is applied to tool body surfaces 30, 32 such that force is transmitted to the connector 52 to overcome frictional engagement with a mating connector.

Additionally, tool 10 may be used in conjunction with hex head screws, as shown in FIG. 1. The first surface 20 of tool 10 has an opening 28 therein to accommodate a metal insert 34. The metal insert 34 is affixed within said opening 28. Insert 34 has a hexagonally shaped opening 36 for receiving therein a hex head computer screw 38. A hex head screw may be easily removed by engaging the hex head screw 38 with the hexagonally shaped opening 36 and rotating tool 10 about the axis of the hex head screw 38.

Advantageously, the tool provides a uniform force in removing connectors from mating connectors, and aids to prevent excessive force from being applied to a connector. The tool is lightweight, inexpensive, and easy to use. Furthermore the tool is small enough such that it can be easily transported within a computer case.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A tool for removing and installing connectors having connector ribs from mating connectors, the tool comprising:

a tool body having a cut-out therein;

said cut-out defining an engagement surface;

said engagement surface having at least one channel therein for coupling with said connector ribs;

a first surface containing a hex opening for receiving therein a hex head of a screw; and wherein the hex opening is defined by an insert formed integral with the tool.

2. The tool as recited in claim 1 wherein the insert is machined out of metal.

3. The tool as recited in claim 1 wherein the engagement surface has a plurality of channels therein for accommodating various male and female connectors.

4. The tool as recited in claim 3, wherein the engagement surface has a cavity for engaging with at least one female connector.

5. The tool as recited in claim 1 further comprising a slip resistant surface.

6. The tool as recited in claim 5 wherein the slip resistant surface is further comprised of adhesive backing.

7. The tool as recited in claim 1 wherein said tool is molded from a substantially rigid material.

8. The tool as recited in claim 1 wherein said tool is machined from a substantially rigid material.

9. A tool for removing and installing computer connectors from mating connectors, the tool comprising:

a tool body having a cut-out therein;

said tool body having a first surface with an opening for receiving an insert therein;

said cut-out defining two side engagement surfaces and a bottom engagement surface, said side engagement surfaces having two opposed channels therein for coupling with a standard computer connector rib;

said bottom surface having a cavity therein for receiving therein a connector for a 3½" disk drive; and the insert affixed within the opening in the first surface, said insert having a hex opening for receiving a hex head of a screw ussed to fasten parts of a computer together.

* * * * *